United States Patent [19]

Biedebach

[11] 4,147,320

[45] Apr. 3, 1979

[54] POT HANGER

[76] Inventor: Lawrence W. Biedebach, 2225 Primrose St., Vista, Calif. 92083

[21] Appl. No.: 824,511

[22] Filed: Aug. 24, 1977

[51] Int. Cl.[2] ..... A47G 7/00

[52] U.S. Cl. ..... 248/318; 47/67

[58] Field of Search ..... 248/318; 47/39, 67; 220/92, 95; D11/148; D6/113

[56] References Cited

U.S. PATENT DOCUMENTS

| | | | |
|---|---|---|---|
| D. 13,297 | 9/1882 | Allen | D11/148 |
| 1,358,385 | 11/1920 | Molthan | 220/95 |
| 1,677,222 | 7/1928 | Whitney | 220/95 X |
| 2,533,845 | 12/1950 | Stender | 248/318 |
| 3,867,788 | 2/1975 | Mickelson | 248/318 X |

FOREIGN PATENT DOCUMENTS

| | | | |
|---|---|---|---|
| 2505456 | 4/1975 | Fed. Rep. of Germany | 47/67 |
| 251592 | 11/1947 | Switzerland | 47/67 |

*Primary Examiner*—J. Franklin Foss
*Attorney, Agent, or Firm*—Brown & Martin

[57] ABSTRACT

A pot hanger includes a plurality of strands of high tensile wire secured together forming a hook and plurality of tines extending from the hook outward with each tine including a generally Z-shaped hook at the outer end thereof.

2 Claims, 4 Drawing Figures

POT HANGER

BACKGROUND OF THE INVENTION

The present invention relates generally to pot hangers and pertains particularly to wire pot hangers.

Hanging flowers and other ornamental vegetation must be suspended above the floor or ground at a sufficient height to permit the plant to grow downward without resting or hitting the floor or ground. Such vegetation is typically planted in small pots which are hung by wire hangers from suitable support means. The wire hangers typically include a plurality of strands of soft wire formed in a hook at one end and having the opposite end extending through holes in the pot and twisted around the body of the strand to secure the strands to the pot. Such attachments are time consuming and can become damaged when changed from several different pots.

It is therefore desirable that a fast and economical wire type pot hanger means be available that can be readily secured to a pot and can be readily reused without damage thereto.

SUMMARY AND OBJECTS OF THE INVENTION

Accordingly it is the primary objects of the present invention to overcome the above problems of the prior art.

Another object of the present invention is to provide a wire type pot hanger that is easily and rapidly secured to a pot.

A still further object of the present invention is to provide a wire type pot hanger having hook means that is readily secured to a pot.

In accordance with the primary aspect of the present invention, a pot hanger is constructed of a plurality of strands of high tensile wire forming a hook at one end and a plurality of ties extending from the hook with Z-shaped hook means formed at the ends of each of the tines for engaging bores in a pot for supporting the pot.

BRIEF DESCRIPTION OF THE DRAWINGS

The above and other objects and advantages of the present invention will become apparent from the following description when read in conjunction with the drawings, wherein.

DETAILED DESCRIPTION OF A PREFERRED EMBODIMENT

Figure 1:
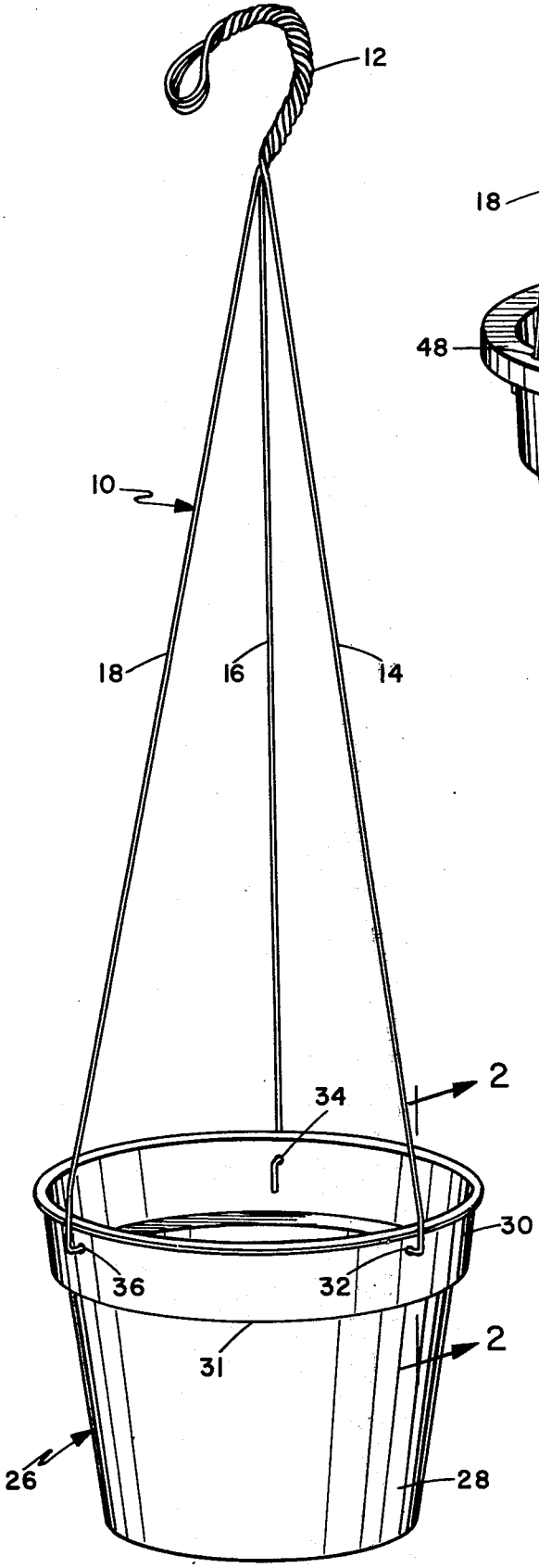
FIG. 1 is a perspective view of the hanger attached to one type of pot.

Turning now to FIG. 1 of the drawing, there is illustrated a pot hanger in accordance with the invention, designated generally by the numeral 10. The pot hanger comprises a plurality of strands of wire secured together forming a hook 12 at the upper end thereof and a plurality of tines 14, 16, and 18 extending downward away from the hook portion. Although the hanger is illustrated as having three tines or fingers, it may have as little as two or more than three. The three being an ideal configuration providing adequate support and also preventing tipping of the pot.

Figure 2:
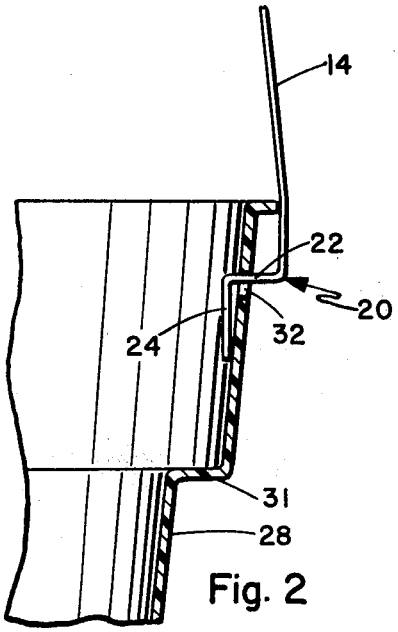
FIG. 2 is an enlarged sectional view taken on line 2—2 of FIG. 1.

The tines of pot hanger 10 are shaped at the outer ends to define generally Z-shaped hook means. These hook means, as best seen in FIG. 2, are formed by shaping the end of each tine or strand of wire into a generally Z-shaped configuration. The stiffness of the wire is selected to be sufficient to support the pot and its weight simply by means of the hook means. The wires are preferably selected to have a tensile strength of between 65 and 135 psi. This provides sufficient stiffness in the wire to retain the shape and to support a pot filled with soil and plants. Preferable the tensile strength is in the neighborhood of 135 psi.

As best seen in FIG. 2, the tine 14 is shaped to define a generally Z-shaped hook generally designated by the numeral 20 and comprising a first portion 22 extending at substantially right angles to the main body portion of the tine 14 and a second portion 24 extending generally parallel to the main body portion of the tine 14. Each of the tines is formed with a similar hook means having the same configuration. This structure is designed to cooperate with any number of different structures or configurations of pots for supporting the pots.

As best seen in FIGS. 1 and 2, a pot of a generally cylindrical configuration designated generally by the numeral 26 and having a lower portion thereof having the configuration of a frustrom of a cone defined by generally annular upwardly extending walls 28 and an upper rim 30 defining a shoulder 31 between the main portion thereof and the rim 30. The rim 30 is provided with a plurality of bores 32, 34 and 36 through which the hooks on the ends of the respective tines or strands 14 through 18 extend for supporting the pot. As best seen in FIG. 2 the generally Z-shaped hook means extends through the generally horizontally extending bore 32 in the wall of the rim portion 30 for supporting the bucket. The first portion 22 of the hook extends horizontally through the bore or hole 32 and the second portion 24 extends downward for engagement with the inner side of the wall of the bucket for retaining the hook in place.

The wires 14 through 18 are preferably of a high tensile steel, such as between 65 and 135 psi and have a somewhat spring like characteristic. Thus, the wires or tines may be easily deflected to insert the ends 24 into bores 32 and spring back to the configurations as seen in FIG. 1. The strength of the hook means 20 is sufficient to hold and support a fully loaded pot. The pots may be of any suitable material, such as plastic, clay, cement or the like and may have quite a number of different configurations.

Figure 3:
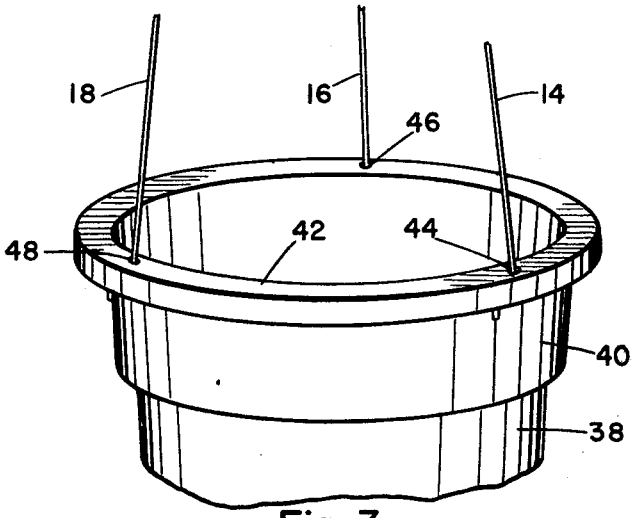
FIG. 3 is a perspective view showing the hanger attachment to another type of pot.

Turning now to FIG. 3, there is illustrated an alternate construction for a pot which may be supported by the hanger of the present invention. The pot of FIGS. 3 and 4, comprises a generally cylindrical main body 38 defined by generally vertically extending annular walls forming a rim portion 40 at the upper end thereof, with an open mouth surrounded by a generally radially extending flange 42. The flange 42 includes or is provided with a plurality of generally vertically extending bores 44, 46 and 48 extending therethrough. These bores are designed to receive the hook means of the respective tines 14 through 18.

Figure 4:
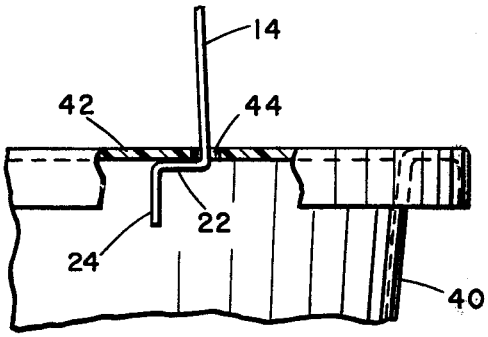
FIG. 4 is an enlarged side elevational view partially cut away showing the structure of FIG. 3.

As best seen in FIG. 4, the tines 14 extend downward through the bore 44 with the first portion 22 extending horizontally for engaging the under side of the flange 42 for supporting the structure or pot. The tine 14 and hook portion is easily inserted into bore 44 simply by inserting first the portion 24 and then tilting or deflecting the tine until the portion 22 extends therethrough as shown in FIG. 4. The tine will then spring back to its original configuration for supporting the pot as illustrated in FIGS. 3 and 4.

This construction provides a pot hanger which is readily and quickly attached to a pot of various configurations. The generally Z-shaped hook portion quickly inserts into a bore in the upper rim or wall of the pot for supporting the pot.

While the present invention has been illustrated and described by means of specific embodiments, it is to be understood that numerous changes and modifications may be made therein without departing from the spirit and scope of the invention as defined in the appended claims.

Having described my invention, I now claim:

1. A pot hanger in combination with a flower pot;

said pot hanger comprising a plurality of strand of high tensile wire secured together and forming a hook portion and at least three tines extending outward from said hook portion, and a generally Z-shaped hook member formed on the end of each of said tines for cooperatively engaging bores in the wall of a container for supporting the container, said hook members are each defined by a first portion that extends at substantially a right angle to said tine and a second portion that extends substantially parallel to said tine in a direction away from the tine;

said pot having a generally cylindrical open top configuration defined by a generally annular vertically extending wall, a plurality of horizontal bores in said wall adjacent the open top for receiving said hook means, so that said first portion of said hook means extends through said bores and said second portion engage the inside of said wall for retaining said hook means in position in said bore.

2. A pot hanger in combination with a flower pot;

said pot hanger comprising a plurality of strands of high tensile wire secured together and forming a hook portion and at least three tines extending outward from said hook portion, and a generally Z-shaped hook member formed on the end of each of said tines for cooperatively engaging bores in the wall of a container for supporting the container, said hook members are each defined by a first portion that extends at substantially a right angle to said tine and a second portion that extends substantially parallel to said tine in a direction away from the tine;

said flower pot having a generally cylindrical open top configuration defined by an annular vertically extending wall, a flange extending radially outwardly from the top of said wall, a plurality of generally vertically extending bores formed in said flange for receiving said tines with said hook means extending therethrough so that said first portion engages said flange for supporting said pot.

* * * * *